US009995190B2

(12) United States Patent
Levorsen

(10) Patent No.: US 9,995,190 B2
(45) Date of Patent: Jun. 12, 2018

(54) CONTACT HEATER

(71) Applicant: DEFA AS, Nesbyen (NO)

(72) Inventor: Ole Henrik Levorsen, Nesbyen (NO)

(73) Assignee: DEFA AS, Nesbyen (NO)

( * ) Notice: Subject to any disclaimer, the term of this patent is extended or adjusted under 35 U.S.C. 154(b) by 69 days.

(21) Appl. No.: 15/036,396

(22) PCT Filed: Nov. 13, 2014

(86) PCT No.: PCT/NO2014/050213
§ 371 (c)(1),
(2) Date: May 12, 2016

(87) PCT Pub. No.: WO2015/072861
PCT Pub. Date: May 21, 2015

(65) Prior Publication Data

US 2016/0265401 A1 Sep. 15, 2016

(30) Foreign Application Priority Data

Nov. 15, 2013 (NO) ..... 20131519

(51) Int. Cl.
*F01M 5/02* (2006.01)
*H05B 3/22* (2006.01)
(Continued)

(52) U.S. Cl.
CPC ..... *F01M 5/021* (2013.01); *F01M 5/001* (2013.01); *F01P 11/20* (2013.01); *F02N 19/04* (2013.01);
(Continued)

(58) Field of Classification Search
CPC ..... H05B 1/0202; H05B 3/0014; H05B 3/40; H05B 2203/032; H05B 1/0236;
(Continued)

(56) References Cited

U.S. PATENT DOCUMENTS 1,870,619 A 8/1932 Flanzer
2,698,374 A 12/1954 Carpenter
(Continued)

FOREIGN PATENT DOCUMENTS

DE 1286242 B 1/1969
DE 8632660 U1 1/1988

OTHER PUBLICATIONS

"530D Auxiliary Heater—5Series.Net—Forums", Available Online at <http://5series.net/forums/e60-discussion-2/530d-auxiliary-heater-126139/>, Aug. 9, 2012, 3 pages.
(Continued)

*Primary Examiner* — Long T Tran
(74) *Attorney, Agent, or Firm* — Morrison & Foerster LLP

(57) ABSTRACT

A contact heater comprising a heating member and a contact surface, where the contact surface is adapted for abutment towards a portion of an engine, gearbox, or similar, which is to be heated. The heating member comprises at least one PTC element and connection means for electrical energy supply, and the contact surface constitutes a portion of a contact element which is releasably connected to the heating member by connection means.
The contact heater is suitable for use on an engine, for example an automobile engine, an engine block, a sump, a gearbox or a part of the transmission system for a vehicle.

13 Claims, 4 Drawing Sheets

(51) Int. Cl.

| | |
|---|---|
| ***F01P 11/20*** | (2006.01) |
| ***F01M 5/00*** | (2006.01) |
| ***H05B 3/78*** | (2006.01) |
| ***F02N 19/04*** | (2010.01) |
| ***H05B 1/02*** | (2006.01) |
| *F02N 19/02* | (2010.01) |

(52) U.S. Cl.
CPC ..... *H05B 1/02* (2013.01); *H05B 3/22* (2013.01); *H05B 3/78* (2013.01); *F01P 2037/02* (2013.01); *F01P 2070/04* (2013.01); *F02N 19/02* (2013.01); *H05B 2203/02* (2013.01)

(58) Field of Classification Search
CPC ..... H05B 1/0244; H05B 2203/02; H05B 2203/023; F01M 5/001; F01M 5/021
See application file for complete search history.

(56) References Cited

U.S. PATENT DOCUMENTS

| | | | | |
|---|---|---|---|---|
| 2,838,648 | A | 6/1958 | Ladue | |
| 4,313,048 | A | 1/1982 | Holbrook | |
| 4,755,657 | A * | 7/1988 | Crim | F04B 39/0207 219/536 |
| 4,815,431 | A * | 3/1989 | Yorita | F01M 5/021 123/196 AB |
| 5,252,036 | A | 10/1993 | Bunch et al. | |
| 2011/0076162 | A1 * | 3/2011 | Heidecker | F04B 39/121 417/313 |

OTHER PUBLICATIONS

International Preliminary Report on Patentability received for PCT Patent Application No. PCT/NO2014/050213, dated Jan. 18, 2016, 7 pages.
International Search Report and Written Opinion received for PCT Patent Application No. PCT/NO2014/050213, dated Mar. 2, 2015, 9 pages.

* cited by examiner

CONTACT HEATER

CROSS-REFERENCE TO RELATED APPLICATION

This application is a U.S. National Stage patent application of PCT/NO2014/050213, filed on Nov. 13, 2014, which claims priority to Norwegian Application No. 20131519 filed on Nov. 15, 2013, the entire contents of each one of which is incorporated herein by reference.

FIELD OF INVENTION

The invention concerns heating devices, in particular for use in heating a unit in a vehicle or vessel. More specifically, the invention concerns a contact heater as specified in the preamble of claim 1.

BACKGROUND OF THE INVENTION

Heaters for engines in various vehicles or vessels are well known. The purpose of these heaters is to pre-heat the vehicle engine by direct or indirect heating of the engine's oil or cooling liquid, such it starts easier in cold weather. Heaters for other mechanical units in a vehicle or vessels, such as gearbox, hydraulic system, transmission, are also known.

There are different types of engine heaters. One type comprises a compartment with an electric heating element placed inside. The compartment has an inlet opening and an outlet opening such that the engine's cooling liquid hose may be cut and the hose ends connected to these openings. The engine heater is thus a part of the engine's cooling circuit, and the cooling liquid is heated by the heating element and circulates in the engine's cooling circuit. Another type comprises an electric heating element which is inserted into the engine block, for example through a freeze plug and connected there, in order to heat the cooling liquid inside the engine.

A third type is a so-called contact heater, where an electrical heating element is mounted onto the engine (on e.g. the engine block or sump) and with an abutting surface in direct contact with a part of the motor, such that the liquids inside the motor (oil or cooling liquid) are heated by convection heat from the contact heater via the engine block wall. Contact heaters comprise generally an electric heating element, where the heating element in principle is an electric resistance which generates heat when it is subjected to an electrical potential. The heating element is usually cast inside an aluminium element which is configured to fit the geometry of the region of mounting, It is known to apply heat conducting paste to the heater's contact surface, in order to enhance heat transfer from the contact heater to the engine block or sump. The invention concerns a contact heater.

U.S. Pat. No. 2,838,648 describes a contact heater comprising a metal housing which is configured for mounting an engine crankcase. An electric, and manually controlled, heating element is arranged in a compartment in the housing.

One weakness associated with the known contact heaters is the risk of overheating, even if it has a thermal protection (which is not common in all heaters). This may lead to carbonizing of the oil and hence a deterioration of the oil's lubricating properties, For those heaters without a thermal protection, overheating may also occur if the heater is not properly mounted on the engine, gearbox, etc. Overheating may led to ignition and fire. It is also a disadvantage that contact heaters must be custom made for the specific motor type, gearbox, etc. in order for it to fit on the exterior geometry of the location where it is to be mounted. This results in that contact heaters often are more expensive to manufacture, than other types of engine heaters.

The invention provides solutions that mitigates some of the weaknesses associated with the known engine heaters, and provides additional advantages.

SUMMARY OF THE INVENTION

The invention is described and characterized in the independent claim, while the dependent claims express other features of the invention.

It is thus provided a heating device, comprising a heating member and a contact surface, where the contact surface is adapted for abutment against a portion of a unit which is to be heated, characterized in that the contact surface constitutes a portion of a contact element which is releasably connected to the heating member by connection means.

In one embodiment, the heating member comprises a housing having an internal compartment with an opening in one end, and means for sealing off the compartment.

The contact element comprises a surface configured for abutment against a corresponding part of the heating member.

In one embodiment, the heating member comprises at least one electrical heating element and connection means for electrical energy supply. The electrical heating element is preferably a PTC element.

The contact surface comprises elevated portions and recesses that are complementary with said portion of the unit.

The device according to the invention is particularly suitable for a unit which is placed in a vehicle or a vessel and holds a liquid. The unit may be an engine, for example an automobile engine, an engine block, a sump, a gearbox or a part of the transmission system for a vehicle.

The invented device comprises attachment means for mounting the heating device on the unit. In one embodiment, the attachment means is placed on the heating member. The attachment means is preferably placed on opposite side from the contact surface.

In one embodiment, the heating device comprises a thermostat switch connected between the at least one electrical heating element and the electrical energy supply, and wherein the thermostat switch is configured to cut the power supply to the heating element when the temperature sensed by the thermostat switch exceeds a pre-determined temperature, and to re-establish connection between the heating element and the energy supply when the sensed temperature drops below the pre-determined temperature. The thermostat switch is preferably mechanically connected to the heating element.

The contact heater's two-part configuration (heating member and removable contact element) facilitates rationalization of manufacture and logistics. While the shape of the contact element is adapted to the individual engine, the heating member may be standardized. In cases where the contact heater is to be mounted on a plane surface, it is sufficient to only attach the heating member to the engine; the contact element may be omitted.

One advantage in using PTC elements in the heating member is that overheating of the engine is avoided, as the effect in the heating element is reduced significantly and to acceptable levels as the heating member temperature increases. The invented contact heater may be used on units (e.g. sumps) made of plastic and/or composite materials if the PTC element reference temperature is sufficiently low.

The contact heater according to the invention is well suited for mounting on an engine, but is also suitable for mounting onto other units in the vehicle. Such units comprise e.g. engine block, sump, crankcase, gearbox, hydraulic systems, differential, etc.

BRIEF DESCRIPTION OF THE DRAWINGS

The above mentioned and other features of the invention will be described in the following description of a preferred embodiment, provided as a non-limiting example, with reference to the attached drawings, wherein.

DETAILED DESCRIPTION OF PREFERRED EMBODIMENTS

Figure 1:
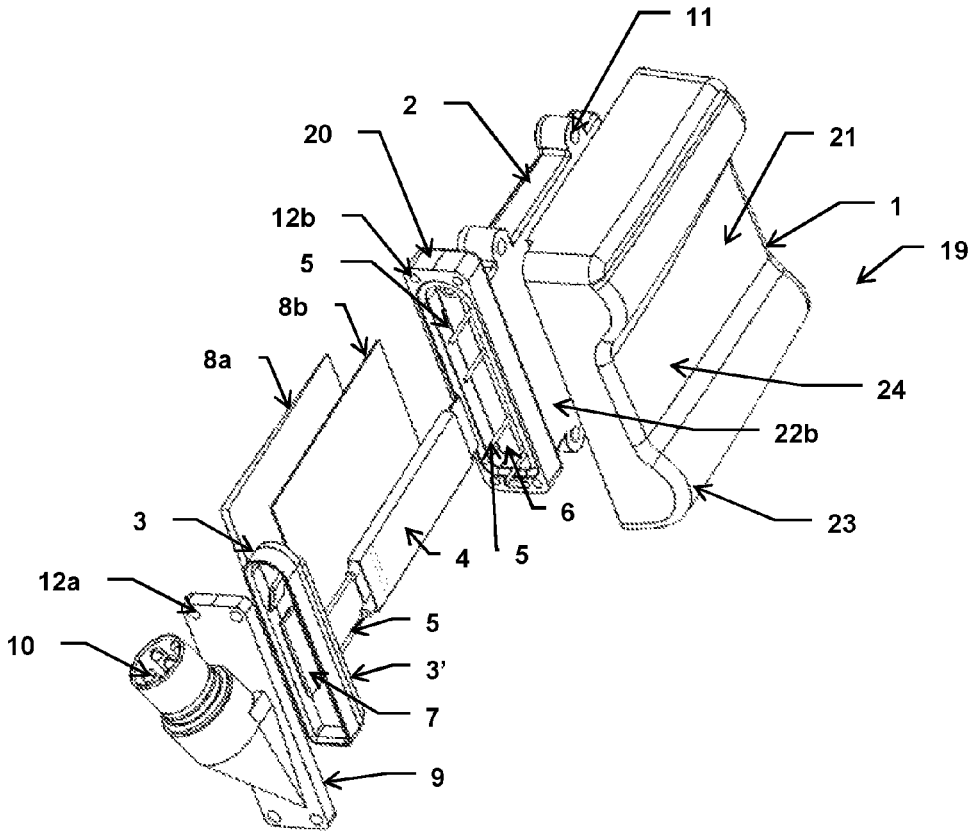
FIG. 1 is an exploded view of an embodiment of the contact heater according to the invention.
Figure 2:
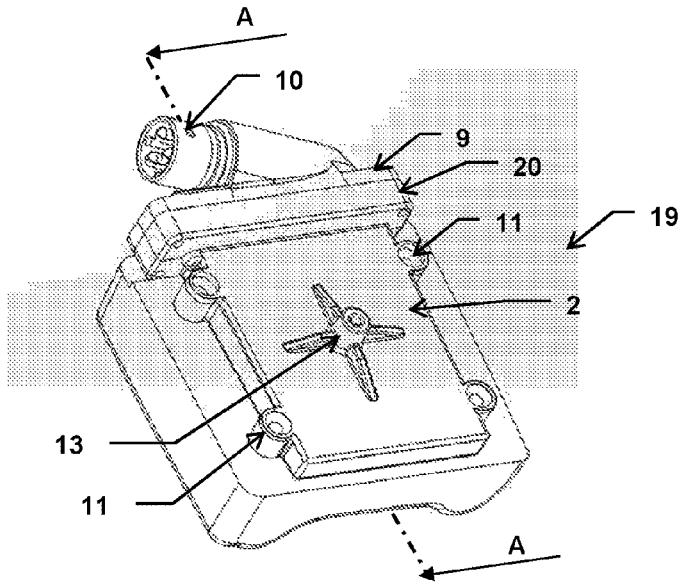
FIG. 2 is a perspective view of the contact heater shown in FIG. 1, in an assembled state.
Figure 3:
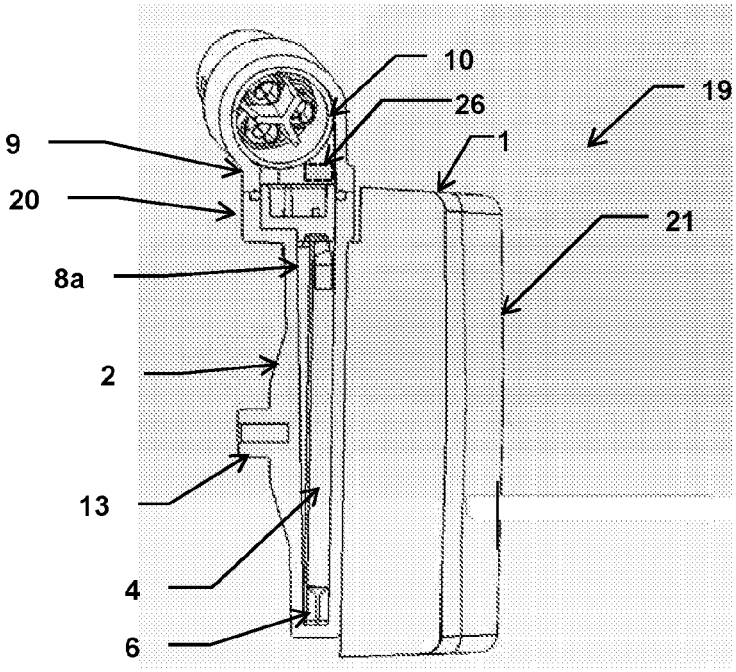
FIG. 3 is a sectional drawing of the contact heater shown in FIG. 2, along the section line A-A in FIG. 2.

FIGS. 1-3 show an embodiment of the contact heater 19 according to the invention. As shown in e.g. FIG. 2, the contact heater 19 comprises a housing 2 and a contact element 1 that are releasably connected to each other. The housing 2 has in the illustrated embodiment four holes 11 such that the house by means of screws (not shown) may be screwed into threads (not shown) in the contact element 1 for thereby to interconnect the housing and the contact element. The housing is also provided with a cover 9 which is connected to a flange 20 and also carries a socket 10 for connection to an electrical cable 17 (shown in FIGS. 7 and 8). On that side of the housing 2 which is not attached to the contact element 1, is arranged an attachment plug 13, which is used when the contact heater is to be attached to the a unit such as an engine, gearbox, or similar.

As shown in FIGS. 1 and 3, the housing 2 comprises an internal compartment 6 with an opening in one end. In the compartment 6, so-called PTC-elements 4 are arranged (PTC is an abbreviation for "Positive Temperature Coefficient"). In the illustrated embodiment, the housing holds three PTC-elements (the exploded view in FIG. 1 shows two PTC elements installed in the compartment 6 and one PTC-element 4 outside). A wedge-shaped press plate 8*a* holds the PTC-elements firmly in place in the compartment and ensures good heat conduction between the PTC-elements and the housing material. Between the wedge-shaped press plate 8*a* and the PTC-element a gliding plate 8*b* is arranged in order to protect the PTC-element. On assembly, the PTC-element and the sliding platen are first inserted down into the compartment, before the wedge-shaped press plate is pressed in between the housing internal compartment or an adjacent gliding plate. That way, damage to the PTC element is avoided. Both the housing 2 and the contact element 1 are of materials with good heat conductive properties. A suitable material is aluminium.

Each PTC element has wires 5 for connection to a contact holder 3 which in turn is provided with contacts 7 for connection to a socket 10 which is attached to a cover 9. The contact holder 3 is furnished with a gasket 3' such that the contact holder and the gasket closes and seals the opening of the compartment 6 when the parts are assembled. The cover 9 has an edge with screw holes 12*a* and which are adapted for mounting towards corresponding screw holes 12*b* in the housing 2 flange 20. The contact holder 3 is thus kept in pace and the compartment 6 is sealed when the cover 9 is attached to the flange 20, e.g. with suitable screws (not shown) in the holes 12*a,b*.

PTC elements are as such well known and need therefore not be described in detail here. It shall only briefly be mentioned that a PTC element is a semiconductor whose internal electrical resistivity increases rapidly (exhibits a steep, positive gradient) with increasing temperature when the temperature has exceeded a reference value which is specific for the element. A PTC element is therefore self-controlling in the sense that it cannot overheat: when the temperature in the PTC element exceeds the reference value, the electrical resistance also increases and the energy supply decreases. When the temperature decreases, the resistance decreases such that the electrical current through the element increases.

FIG. 3 illustrates an optional thermostat switch 26 assembled in the housing 2, and which is connected to the power supply and to the PTC element via wires (not shown) in a manner that per se is known in the art. The thermostat switch 26 is configured to cut the power supply to the PTC element if it is exposed to (i.e. senses) a temperature which is higher than a pre-set temperature, and to reconnect the power supply and the PTC element when the sensed temperature drops below the pre-set temperature. Such thermostat control provides an additional safety feature against overheating, if, for example, the contact heater should become dislodged and even fall off of the engine block, gearbox, etc.

The contact element 1 has a contact surface 21 which is shaped such that it fits with (is complementary with) the shapes of that portion of the unit (engine, gearbox, etc.) where the contact heater is to be mounted. FIG. 1, which shows an embodiment which is particularly suitable for mounting on a sump or a gearbox, shows how the contact surface 21 has some elevated portions 23 and some recesses 24.

Figure 4:
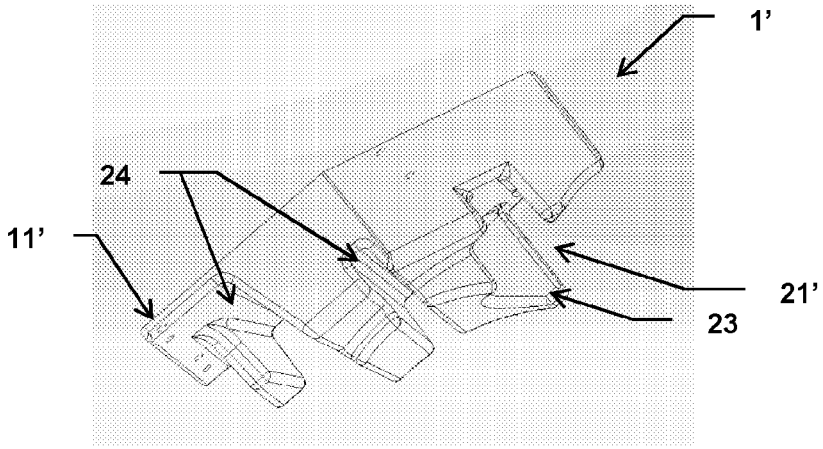
FIGS. 4 and 5 are perspective views of a second embodiment of a contact element for the contact heater according to the invention.
Figure 5:
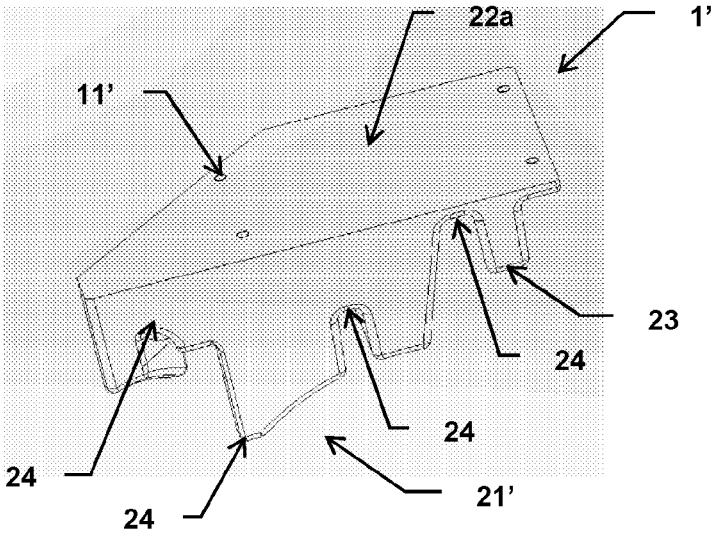

FIGS. 4 and 5 show a second embodiment of the contact element 1' where the contact surface 21' has a shape with several elevated portions 23 and recesses 24. This embodiment is particularly useful for mounting on an engine block with outwardly projecting cooling fins. FIG. 5 also shows the mounting holes 11' for the housing, and the plane surface 22*a* which the housing is bearing against.

Figure 6:
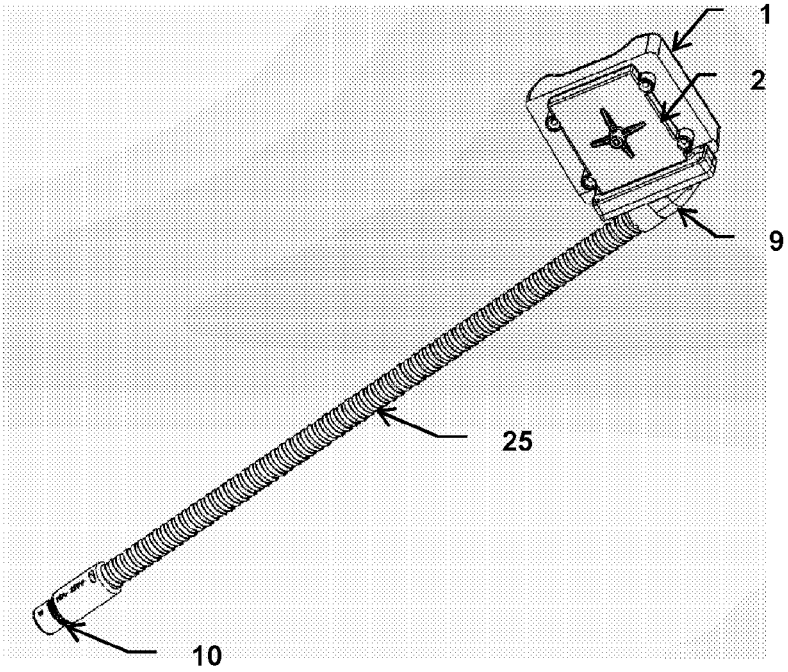
FIG. 6 is a perspective view of a variant of the contact heater according to the invention, with an extension cord.

FIG. 6 shows a variant of the contact heater with an extension cable 25 between the cover 9 and the socket 10. The extension cable, which may be rigid or have a certain elasticity, enables the contact heater to be mounted on suitable locations and the socket is easily accessible for the user.

Figure 7:
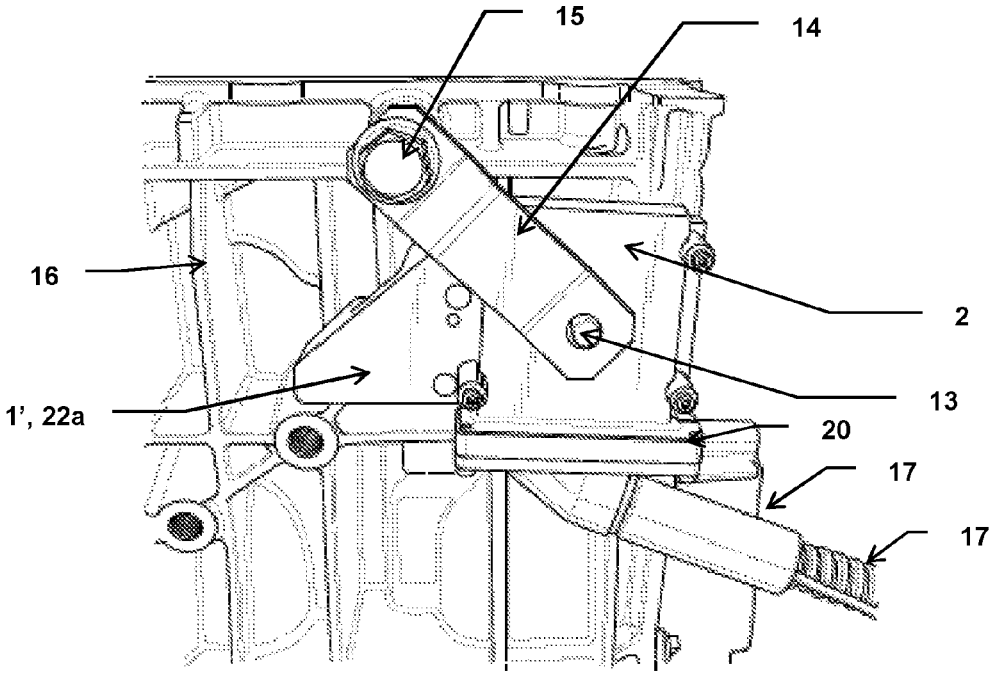
FIGS. 7 and 8 are perspective views of an embodiment of the contact heater attached to an engine block.
Figure 8:
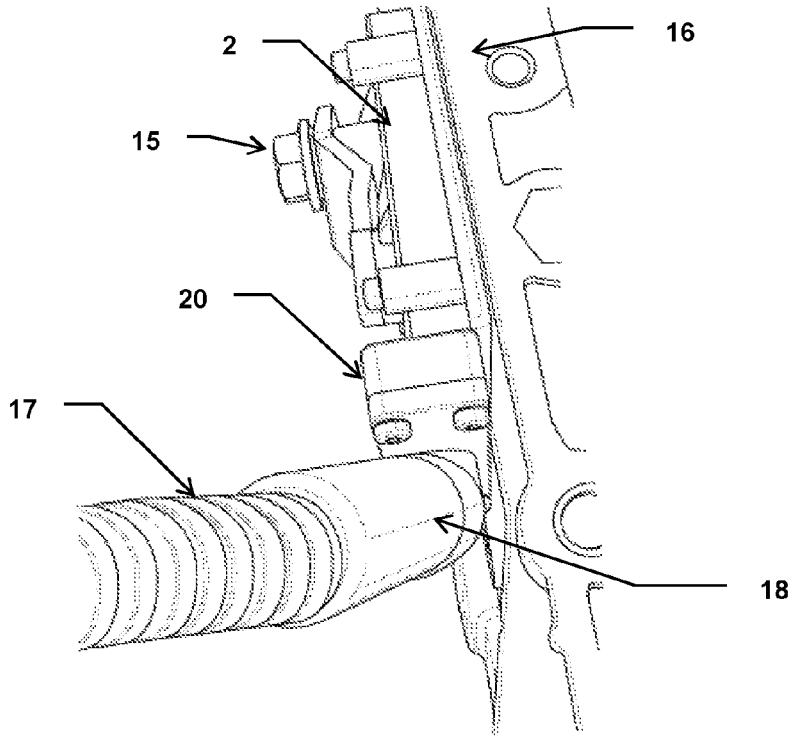

FIGS. 7 and 8 show the contact heater mounted on an engine 16. The elevated portions of the contact surface fits into the corresponding recesses on the engine. The contact heater is held in position against the engine 16 by means of a fixing plate 14 which in one end is connected to the attachment plug 13 via a hole and in a second end is attached to the engine by means of a bolted connection 15. The fixing plate 14 is preferably configured as a bent spring element, such that the contact heater is clamped towards the engine when the bolted connection is 15 tightened. It is also shown how an electrical cable 17 with a plug 18 is connected to the socket 10, such that the PTC elements are provided with electrical currents in a known manner.

Even though the invention has been described with reference to an engine, it should be understood that it is suitable for mounting on other units, such as engine block, sump, crankcase, gearbox, differential.

The invention claimed is:

1. A contact heater for a heating a unit in a vehicle or vessel, comprising:

a heating member; and a contact element, wherein the contact element comprises a first contact surface which is adapted for direct abutting contact with a portion of the unit, the heating member and the contact element are separate units, the contact element comprises a second contact surface on an opposing surface side of the first contact surface and configured for direct abutting contact with a corresponding part of the heating member, and the contact heater further comprises a connector by which the heating member and the contact element are releasably connected to each other.

2. The contact heater according to claim 1, wherein the heating member comprises a housing having an internal compartment with an opening in one end, and a sealing member for sealing off the compartment.

3. The contact heater according to claim 1, wherein the heating member comprises at least one electrical heating element and a socket for connection to an electrical cable.

4. The contact heater according to claim 3, wherein the electrical heating element is a PTC element.

5. The contact heater according to claim 1, wherein the first contact surface comprises elevated portions and recesses that are complementary with said portion of the unit.

6. A method of using the contact heater as defined by claim 1, comprising:

providing the contact heater; and placing the contact heater on a unit which is placed in a vehicle or a vessel and holds a liquid.

7. A method of using the contact heater as defined in claim 1, comprising:

providing the contact heater, and placing the contact heater on a unit, where the unit is one of the following: an engine, an engine block, a sump, a gearbox or a part of the transmission system for a vehicle.

8. The contact heater according to claim 1, comprising a mount for mounting the contact heater on the unit.

9. The contact heater according to claim 8, wherein the mount is placed on the heating member.

10. The contact heater according to claim 8, where the mount is placed on opposite side from the first contact surface.

11. The contact heater according to claim 8, further comprising a thermostat switch configured to cut power supply to the heating element when the temperature sensed by the thermostat switch exceeds a pre-determined temperature, and to re-establish connection between the heating element and an energy supply when the sensed temperature drops below the pre-determined temperature.

12. The contact heater according to claim 11, wherein the thermostat switch is mechanically connected to the heating element.

13. The contact heater according to claim 8, wherein the connector comprises holes for screws.

* * * * *